United States Patent [19]

Hashiguchi et al.

[11] B 3,999,737

[45] Dec. 28, 1976

[54] FLOW CONTROL VALVE FOR EXHAUST GAS PURIFYING SYSTEM

[75] Inventors: Yukihide Hashiguchi; Ryozo Mitsui, both of Susono, Japan

[73] Assignee: Toyota Jidosha Kogyo Kabushiki Kaisha, Toyota, Japan

[22] Filed: June 18, 1974

[21] Appl. No.: 480,384

[44] Published under the second Trial Voluntary Protest Program on March 23, 1976 as document No. B 480,384.

[30] Foreign Application Priority Data

July 25, 1973 Japan ..... 48-83052

[52] U.S. Cl. ..... 251/28; 123/119 A; 137/480

[51] Int. Cl.[2] ..... F02B 33/00

[58] Field of Search ..... 123/119 A; 60/278; 251/25, 28; 137/480, 479

[56] References Cited

UNITED STATES PATENTS

| | | | |
|---|---|---|---|
| 3,507,260 | 4/1970 | Walker | 123/119 A |
| 3,756,210 | 9/1973 | Kuehl | 123/119 A |
| 3,799,131 | 3/1974 | Bolton | 123/119 A |
| 3,834,363 | 9/1974 | Goto et al. | 123/119 A |

*Primary Examiner*—Charles J. Myhre
*Assistant Examiner*—James D. Liles
*Attorney, Agent, or Firm*—Stevens, Davis, Miller & Mosher

[57] ABSTRACT

A flow control valve for an exhaust gas purifying system which is divided into a first valve chamber into which the exhaust gases flow and a second valve chamber out of which the exhaust gases flow. A first valve means responsive to the exhaust gases controls the communication between the first and second valve chambers and a second valve means controls the operation of the first valve means in response to the negative pressure in an air intake system.

3 Claims, 2 Drawing Figures

FLOW CONTROL VALVE FOR EXHAUST GAS PURIFYING SYSTEM

BACKGROUND OF THE INVENTION

The present invention relates to generally an exhaust gas recirculation system for recirculating the exhaust gases from an exhaust system to an intake system of an internal combustion engine in order to minimize the contents of nitrogen oxides in the exhaust gases, and more particularly a flow control valve for controlling the flow rate of the recirculated exhaust gases in the exhaust gas recirculation system.

In the conventional exhaust gas purifying system, a flow control valve, which controls the flow rate of the recirculated exhaust gases, is opened in response to the pressure of the recirculated exhaust gases and is closed by the pressure of the secondary air supplied to an exhaust gas purifying system such as a thermal reactor when the speed of an automotive vehicle exceeds a predetermined speed or when the temperature of the engine exceeds a predetermined temperature. However, the pressure of secondary air is considerably decreased when a line for charging secondary air to a flow control valve is damaged, when the secondary air is bypassed or when a magnet clutch type air pump is used. As a result the flow control valve cannot interrupt the recirculation of exhaust gases so that the exhaust gases are recirculated into the intake system, thus adversely affecting the engine operation.

SUMMARY OF THE INVENTION

The present invention was therefore made to overcome the above and other defects or problems encountered in the conventional flow control valves for use with the systems of the type described. Briefly stated, in accord with the present invention, a flow control valve is controlled by a first valve means responsive to the exhaust gas pressure from an exhaust system and further by a second valve means responsive to the negative pressure in an air intake system of an engine so as to recirculate the exhaust gases from an exhaust system to the intake system. A valve casing is divided into a first valve chamber into which the exhaust gases flow from the exhaust gas system and a second valve chamber out of which the exhaust gases flow into the intake system. A first valve means is interposed between the first valve and second valve chambers in order to control the intercommunication therebetween. The pressure in the first valve chamber is controlled by a second valve means in such a way that the first valve means may intercommunicate between the first valve and second valve chambers. The second valve means is actuated in response to the negative pressure in the intake system. The exhaust gases may be recirculated only when the negative pressure is acting upon a diaphragm which in turn is operatively coupled to the second valve means.

The present invention will become more apparent from the following description of one preferred embodiment thereof taken in conjunction with the accompanying drawings.

DESCRIPTION OF THE PREFERRED EMBODIMENT

Figure 1:
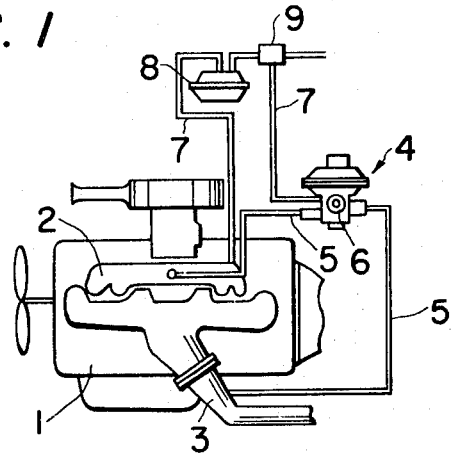
FIG. 1 is a schematic diagram of an exhaust gas purifying system for an internal combustion engine, incorporating a flow control valve in accordance with the present invention.
Figure 2:
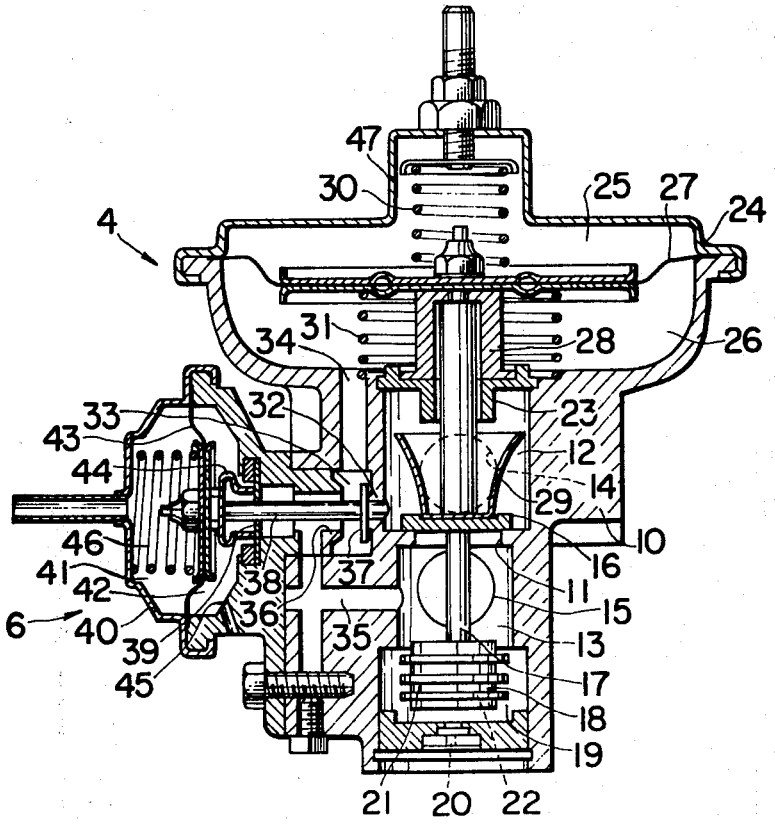
FIG. 2 is a longitudinal sectional view of the flow control valve.

Referring to FIGS. 1 and 2, the fuel-air mixture is supplied to an intake manifold 2 through an air cleaner and a carburetor, and the exhaust gases are discharged through an exhaust manifold 3 extending from an engine body 1. The intake manifold 2 and the exhaust manifold 3 are intercommunicated with each other with conduit pipes 5 through a flow control valve 4. A pressure control unit 6 of the flow control valve 4 is communicated through a conduit pipe 7 with the intake manifold. Therefore, when the negative pressure is applied to the pressure control unit 6, a part of the exhaust gases is recirculated from the exhaust pipe 3 into the intake manifold 2. A vacuum reservoir tank 8 is inserted into the conduit pipe 7 in order to apply a high negative pressure to the pressure control unit 6, and a solenoid controlled valve 9 is also inserted into the conduit pipe 7 in order to interrupt the application of negative pressure to the pressure control unit 6 in case of the engine operation in which it is not necessary to apply negative pressure to the pressure control unit 6.

Next referring to FIG. 2, a valve casing 10 of the flow control valve 4 is divided into a first valve chamber or an upper chamber 12 and a second valve chamber or a lower chamber 13 by a valve seat 11 with an aperture. The upper chamber 12 is communicated with the conduit pipe 5 which in turn is communicated with the exhaust pipe 3, through an inlet port 14, and the lower chamber is communicated through an outlet port 15 with the conduit 5 which in turn is communicated with the intake manifold 2. A valve 16 carried by a shaft or valve stem 17 is disposed in the upper chamber 12 so as to open or close the aperture in the valve seat 11. The lower end of the shaft or valve stem 17 is joined to a piston 18 slidably fitted into a cylinder 19 disposed at the bottom of the lower chamber 13. At the bottom of the cylinder 19 is formed a passage 20 in communication with the surrounding atmosphere, so that the piston 18 may stroke upwardly against the negative pressure acting upon the upper end of the piston 18 in the lower chamber 13. That is, the atmospheric pressure is applied to the lower end of the piston 18 in order to compensate for the weight of the shaft or valve stem 17 carrying the valve 16. More particularly, the valve stem 17 strokes only under the pressure acting upon a diaphragm 27 and the forces of two springs 30 and 31 acting upon the diaphragm 27. Labyrinth packings 22 are fitted over the skirt 21 of the piston 18 in order to minimize the clearance between the piston 18 and the cylinder 19, thereby minimizing the volume of air flowing from the cylinder 19 into the lower chamber 13. The piston 18 and the cylinder 19 are made of a heat- and abrasion-resistive material which also ensures the smooth relative movement between the piston 18 and the cylinder 19.

The upper end of the shaft or valve stem 17 is extended through a guide 23 attached to the valve casing 10 and is joined to the diaphragm 27 disposed within a casing 24. The diaphragm casing 24 is divided into an atmospheric pressure chamber 25 communicated with the surrounding atmosphere through a port 47 and a working pressure chamber 26 by the diaphragm 27. In order to air-tightly seal between the upper chamber 12 and the working pressure chamber 26, a bellows 28 is fitted over the valve stem or shaft 17 and the guide 23, and a protector 29 is fitted to the valve 16 in such a way that when the latter rises the protector 29 may air-tightly seal the guide 23 and the valve stem 17. The springs 30 and 31 disposed in the atmospheric pressure chamber 25 and the working pressure chamber 26, respectively, act upon the diaphragm 27. As described above, the valve shaft 17 carrying the valve 16 strokes depending upon the forces of the springs 30 and 31 and the positive or negative pressures acting upon the diaphragm 27. Thus, when no positive pressure of the recirculating exhaust gas is acting upon the diaphragm 27, the valve stem or shaft 17 strokes downwardly so that the valve 16 seats against the valve seat 11, closing the aperture thereof.

The construction of the pressure control unit 6 of the flow control valve 4 will be described in detail hereinafter. The upper chamber 12 is communicated with the working pressure chamber 26 through a port formed through a valve seat 32 formed at the lower side wall of the upper chamber 12 and a valve chamber 33 and a passage 34 formed in the valve casing 10. The lower chamber 13 is communicated with the valve chamber 33 through a passage 35 formed in the valve casing 10 and an aperture or port formed through a valve seat 36. Within the valve chamber 33 is disposed a valve 37 which may selectively close the port of the valve seat 32 or 36, and a valve shaft or stem 38 carrying the valve 37 extends through the port of the valve seat 36 and a guide 39 beyond the valve casing 10 so that the leading end (the left end in FIG. 2) is fixed to a diaphragm 43 which divides a casing 40 into a negative pressure chamber 41 and an atmospheric pressure chamber 42 which is communicated with the surrounding atmosphere through a port 45. A bellows 44 is fitted over the valve shaft 38 and the guide 39 in order to air-tightly seal between the port of the valve seat 36 and the atmospheric pressure chamber 42. A spring 46 disposed in the negative pressure chamber 41 acts upon the diaphragm 43 so that the valve 37 carried by the valve shaft or stem 38 may normally close the port of the valve seat 32. The negative pressure chamber 41 is communicated with the conduit pipe 7 which in turn is communicated with the intake manifold 2 through the vacuum reservoir tank 8.

Now the mode of operation of the flow control valve with the above construction will be described. When the solenoid controlled valve 9 is opened when the engine is running, the negative pressure in the intake manifold 2 is transmitted to the negative pressure chamber 41 in the pressure control unit 6 through the conduit pipe 7 and the vacuum reservoir tank 8 so that the diaphragm 43 displaces itself against the spring 46. Therefore, the valve 37 closes the port of the valve seat 36, but opens the port of the valve seat 32. As a result, the exhaust gases flow from the exhaust pipe 3 through the conduit pipe 5, the inlet port 14, the upper chamber 12, the port of the valve seat 32, and the passage 34 into the working pressure chamber 26. The positive pressure of the exhaust gases causes the diaphragm 27 to move upwardly against the springs 30 and 31 so that the valve 16 moves away from the valve seat 11, thereby opens the aperture thereof. As a result, the exhaust gases flow from the upper chamber 12 into the intake manifold 2 through the aperture of the valve seat 11, the lower chamber 13, the outlet port 15 and the conduit pipe 5.

Next the mode of operation when the negative pressure in the intake manifold 2 is decreased or when the solenoid controlled valve 9 is closed will be described. Under the above condition, the negative pressure in the negative pressure chamber 41 of the pressure control unit 6 is so low that the spring 46 expands to cause the diaphragm 43 to move in a direction to the right in FIG. 2. As a result the valve shaft 38 is also caused to move to the right so that the valve 37 closes the port of the valve seat 32. Therefore, the lower chamber 13 is communicated with the working pressure chamber 26 through the passage 35, the port of the valve seat 36, the valve chamber 33 and the passage 34, so that the pressure in the working pressure chamber 26 will not rise to a positive pressure. Therefore, the valve 16 securely closes the port of the valve seat 11 so that the exhaust gas may be prevented from being recirculated into the intake manifold 2 from the exhaust gas pipe 3.

When the conduit pipe 7 intercommunicating between the negative pressure chamber 41 of the pressure control unit 6 and the vacuum reservoir tank 8 or the conduit pipe intercommunicating the vacuum reservoir tank 8 and the intake manifold 2 is damaged or disconnected, the spring 46 pushes the diaphragm 43 so that the valve 37 maintains the port of the valve seat 32 closed. Therefore, the recirculation of exhaust gases may be prevented so that the adverse effect on the engine operation may be eliminated and the increase in pollutants in the exhaust gases may be prevented.

As described hereinbefore, in accordance with the present invention, the pressure control unit 6 of the flow control valve 4 is actuated in response to the negative pressure in the intake manifold. When the negative pressure does not actuate the pressure control unit 6, the flow control valve 4 is securely closed so that the adverse effect on the engine operation may be eliminated. Thus the present invention may overcome the defects of the prior art control valves (a) that the secondary air from the air pump is supplied in large quantity to other exhaust gas purifying system when the recirculation of exhaust gases is stopped and (b) that when a magnetic clutch type pressure source is used as a secondary air pressure source, the secondary air pressure acting on a flow control valve temporarily becomes too low to completely close the flow control valve.

What is claimed is:

1. A flow control valve for an exhaust gas purifying system for an internal combustion engine having an intake system for conducting a combustible fluid to the engine, said intake system serving as a source of negative pressure, and an exhaust system for conducting exhaust gases from the engine wherein a part of the exhaust gases from said exhaust system is recirculated into said intake system comprising:

a valve casing having a first valve chamber for receiving exhaust gases recirculated from said exhaust system, a second valve chamber for discharging said recirculated gases to said intake system, and a valve seat defining an aperture between said first valve chamber and said second valve chamber;

a first valve means normally biased to closing position against said valve seat;

a first valve control means comprising a first atmospheric chamber communicating with atmosphere, a first pressure chamber, and a first diaphragm disposed between and separating said first atmospheric chamber and said first pressure chamber, said first diaphragm being connected to said first valve means thereby to overcome the bias of said first valve means in response to the difference in pressure between the pressures in said first atmospheric chamber and said pressure chamber;

a passage means comprising a first passage communicating said first valve chamber with said first pressure chamber and a second passage communicating said second valve chamber with said first pressure chamber;

a second valve means disposed in said passage means and normally closing said first passage and opening said second passage simultaneously; and a second valve control means comprising a second atmospheric chamber communicating with atmosphere, a second atmospheric chamber adapted to communicate with the intake system of an internal combustion engine to receive negative pressure therefrom, and a second diaphragm disposed between and separating said second atmospheric chamber and said second pressure chamber, said second diaphragm being connected to said second valve means, thereby to move said second valve means into such a position as to open said first passage and close said second passage simultaneously at the time when the negative pressure within said second pressure chamber has reached a predetermined value.

2. A flow control valve for an exhaust gas purifying system defined in claim 1, wherein said passage means is disposed within the body of said valve casing and in which said first passage is connected to said first valve chamber at its one end and to said first pressure chamber at its other end, and said second passage is connected to said second valve chamber at its one end and to said one end of said first passage at its other end.

3. A flow control valve for an exhaust gas purifying system defined in claim 1 further comprising, a compensating means for compensating for the weight of said first valve means including:

a cylinder disposed within said second valve chamber at the end thereof opposite to said first valve means;

a piston slidably disposed within said cylinder and connected to said first valve means at its one end;

and a cover member having an aperture and covering said cylinder at the end thereof facing the other end of said piston.

* * * * *